US005906435A

United States Patent [19]

Callaghan et al.

[11] Patent Number: 5,906,435

[45] Date of Patent: May 25, 1999

[54] PARTICULATE DRUM MIXER WITH SCOOP SECTION AND SEAL ASSEMBLY WITH BLADDER

[75] Inventors: Thomas A. Callaghan; William J. Callaghan; D. Coyne Callaghan, Jr., all of Eau Claire, Wis.

[73] Assignee: Continental Products Corporation, Osseo, Wis.

[21] Appl. No.: 08/741,692

[22] Filed: Oct. 31, 1996

Related U.S. Application Data

[63] Continuation-in-part of application No. 08/337,145, Nov. 10, 1994, abandoned, which is a continuation of application No. 08/120,681, Sep. 13, 1993, abandoned.

[51] Int. Cl.[6] ..... B01F 9/02; B01F 15/00

[52] U.S. Cl. ..... 366/220; 34/242; 277/583; 277/903; 432/115

[58] Field of Search ..... 366/53, 54, 62, 366/63, 93–95, 219, 220, 225, 347, 349; 277/578, 583, 589, 445, 646, 903; 34/242; 432/115

[56] References Cited

U.S. PATENT DOCUMENTS

| | | | |
|---|---|---|---|
| 1,229,978 | 6/1917 | Kuntz | 34/242 X |
| 1,825,261 | 9/1931 | Burnes et al. | 241/101.8 X |
| 2,219,233 | 10/1940 | Locke | 34/242 X |
| 2,334,663 | 11/1943 | Whitney | 277/903 X |
| 2,371,166 | 3/1945 | Harcourt | 277/903 X |
| 2,492,421 | 12/1949 | Golben | 241/101.8 X |
| 2,760,791 | 8/1956 | Neubauer et al. . | |
| 3,007,518 | 11/1961 | Simpson . | |
| 3,088,711 | 5/1963 | Phillips . | |
| 3,147,956 | 9/1964 | Phillips . | |
| 3,203,674 | 8/1965 | Watson | 277/34 X |
| 3,259,372 | 7/1966 | Phillips . | |
| 3,269,707 | 8/1966 | Phillips . | |
| 3,294,243 | 12/1966 | Cerles | 277/583 X |

(List continued on next page.)

FOREIGN PATENT DOCUMENTS

| | | | |
|---|---|---|---|
| 1084970 | 7/1980 | Germany | 241/101.8 |
| 681826 | 10/1952 | United Kingdom | 34/242 |

OTHER PUBLICATIONS

Brochure (4 pages) *Powder and Bulk Engineering,* vol. 3 No. 2, Feb. 1989.

Brochure (1 Sheet–2 Sides) *If You Mix Feed, Either Custom or Manufactured Blends, This Message is Important to Your Profit,* Continental Products Corporation.

Brochure (5 Pages) *Jackel Tumble Mixer,* Jackel Co., Inc.

Brochure (4 Pages) *Continental "Rollo–Mixer" Mark V,* Continental Products Corporation.

Brochure (1 Sheet–1 Side) *If You Mix Feed, Either Custom or Manufactured, This Message is Important to Your Profit,* Continental Products Corporation.

Brochure (4 pages) *Chemical Processing,* Jul. 1985, A Putman Publication.

*Primary Examiner*—Charles E. Cooley

*Attorney, Agent, or Firm*—Kinney & Lange, P.A.

[57] ABSTRACT

A rotary drum mixer mixes product matter in a particulate form. A scoop section for the mixer has scoop blades which are radially enclosed by a peripheral wall which rotates with the drum. A stationary hood includes an outer face portion which covers the end wall of the scoop section and a peripheral portion which covers the peripheral wall of the scoop section, but neither the outer face portion nor the peripheral portion of the stationary hood contact product matter. The scoop blades are relatively flat and are angled into the direction of rotation. A back section is also included for the scoop blades. A seal assembly is positioned toward the inner diameter of the scoop blades and biases radially outward. The seal assembly may alternatively be positioned at the outer diameter of the scoop section, and/or the seal member may alternatively be biased radially outward. An inflatable bladder is used to radially bias the seal member against a hoop. Either the hoop may rotate with the scoop section and the seal member maintained stationary, or the seal member may rotate with the scoop section and the hoop maintained stationary.

26 Claims, 10 Drawing Sheets

U.S. PATENT DOCUMENTS

| | | | |
|---|---|---|---|
| 3,337,222 | 8/1967 | Smith et al. . | |
| 3,338,559 | 8/1967 | Fisher | 366/220 |
| 3,408,083 | 10/1968 | Szymanski . | |
| 3,552,721 | 1/1971 | Phillips . | |
| 3,558,108 | 1/1971 | Jackson . | |
| 3,575,397 | 4/1971 | McDowell | 432/115 |
| 3,584,334 | 6/1971 | Moriya | 241/188.1 |
| 3,628,798 | 12/1971 | Mehlhope | 277/34 |
| 3,724,887 | 4/1973 | Roberts | 34/242 X |
| 3,752,445 | 8/1973 | Nowak . | |
| 3,825,193 | 7/1974 | Lodige et al. | 241/188.1 X |
| 3,829,066 | 8/1974 | Phillips . | |
| 3,897,934 | 8/1975 | Phillips . | |
| 3,967,674 | 7/1976 | Fort . | |
| 4,026,528 | 5/1977 | Kline et al. | 241/101.8 X |
| 4,074,869 | 2/1978 | Johnson | 241/188.1 X |
| 4,111,439 | 9/1978 | Schmidt | 432/115 X |
| 4,213,571 | 7/1980 | Deardorff et al. | 241/101.8 X |
| 4,214,713 | 7/1980 | Wright | 241/285.3 X |
| 4,268,331 | 5/1981 | Stevens | 277/583 X |
| 4,342,555 | 8/1982 | Bohanszky | 432/115 |
| 4,394,021 | 7/1983 | Merila . | |
| 4,448,425 | 5/1984 | von Bergen . | |
| 4,650,340 | 3/1987 | Krawszyk et al. . | |
| 5,425,543 | 6/1995 | Buckshaw et al. | 277/583 X |
| 5,511,795 | 4/1996 | Laubach et al. | 432/115 X |

PARTICULATE DRUM MIXER WITH SCOOP SECTION AND SEAL ASSEMBLY WITH BLADDER

This is a continuation in part of application Ser. No. 08/337,145, filed Nov. 10, 1994, now abandoned which is a continuation of Ser. No. 08/120,681, filed Sep. 13, 1993, now abandoned.

BACKGROUND OF THE INVENTION

The present invention relates to rotary drum mixers and, in particular, it relates to the construction and sealing of a scoop chamber or turbine section of a drum mixer relative to a stationary hood.

A variety of rotary drum mixers for mixing product matter in particulate form are known in the art. Rotary drum mixers typically include a horizontally mounted, open-ended drum which is rotated about the generally horizontal central axis of the drum. A stationary hopper may be positioned on or adjacent the mixer for introducing product matter into the drum. The interior of the drum may include structure to mix the product matter to a desired blend as the drum rotates.

In some drum mixers, a turbine or scoop section is fixedly attached to the open end of the drum. The scoop section has turbine blades or scoop blades which elevate product matter during rotation of the scoop section and then provide a gravitationally directed curtain flow of particulate product out of the scoop blades. The curtain flow provides several advantages. First, the curtain flow helps to randomly mix the particulate product in the curtain, and thus facilitates the overall mixing of the drum mixer. Second, the curtain flow provides a excellent location for evenly spraying or coating a substance on the particulate product during mixing. Additionally, the elevating of the product matter provides a raised location to gravitationally remove or discharge product matter out of the drum mixer.

A stationary hood may be used to enclose the drum open end and the scoop section. A discharge chute may be mounted on the hood central to the scoop blades. A product inlet hopper may also be provided on the stationary hood.

One of the primary problems with horizontally mounted drum mixers is the potential for leakage between the rotating drum/scoop section combination and the stationary hood. A seal member may be positioned between the stationary hood and the outside of the rotating drum. The seal member of the prior art rotary drum mixer generally comprises a rubber stationary seal component on the annular flange and a TEFLON-like rotating seal component affixed to the drum contacting the stationary material as the drum rotated. Such rotary drum mixers as described are illustrated, for example, in U.S. Pat. Nos. 3,552,721 and 3,897,934.

For relatively large-sized product matter, the fixed seal member referenced above relies on the flexibility of its rubber component to maintain a closure for radial run-outs as much as ¼ inch to ⅜ inch around the surface of the rotating member. However, if fine-sized and sub-micron particle sized product matter is being mixed within the rotating drum mixer, the product matter will pass under the fixed seal member. The product matter could then build-up under the stationary rubber-seal and/or pass between the rotating and stationary seal components, thereby compromising the purity of the product matter being mixed and the work environment outside of the rotary drum mixer.

Additionally, should a build-up of product occur on the rotating seal member as described above, the fixed rubber member would wear rapidly.

The Merilä U.S. Pat. No. 4,394,021 describes a contact sealing which contacts a rotating sealing surface. The contact sealing includes a one-piece U-shaped housing creating an annular groove. A pressurized hose is located within the annular groove and abuts a sealing member to press the sealing member against the sealing surface.

A contact sealing as described in the Merilä patent utilizes a one-piece housing with the pressurized hose mounted therein. Over a period of time, however, the hose and the sealing member will wear from use. The nature of the product matter being treated may also affect the life of the hose and/or the sealing member. In any event, when one or both of the hose and/or the sealing member is damaged, or otherwise impaired by wear or use, replacement is required. With the contact sealing as described in the Merilä patent, the very nature of the hose being positioned within a one-piece housing renders the hose and the sealing member very difficult to remove from the housing and the rotary drum mixer. In fact, in order to effectuate repairs, the entire housing must be removed from the drum. Such a feat is tremendously labor intensive and rotary drum mixer "downtime" is dramatically increased. Additionally, during the replacement procedure, damage to the rotary drum mixer is a major concern.

Furthermore, the contact sealing as described in the Meril ä patent is intended for use on rotary drums in iron ore pelletizing plants, i.e., rotary drums having a diameter of between 12" to 36" operating in low purity applications. Due to the vast exposure of almost the entire contact sealing to the product matter being mixed thereby creating traps for product matter to collect, a dangerous, unhealthful environment could be present if the contact sealing of the Merilä patent is used in the mixing or production of pharmaceuticals or food destined for human consumption, which is generally mixed in rotary drums having larger diameters.

A second potential problem with horizontally mounted drum mixers is the possibility of particle grinding between the rotating drum/scoop section combination and the stationary hood. When the drum mixer is used to mix hard abrasive particles such as in the mineral, glass and plastics industries, particle grinding can have very damaging effects. Particle grinding can significantly increase the power required to rotate the drum mixer, leading to increased load on the entire drum mixer drive system. Particle grinding can also lead to wear between the rotating drum/scoop section combination and the stationary hood, and can especially lead to wear of the seal between the rotating drum and the stationary hood. Wear can exacerbate the particle grinding and lead to failure of the seal. Additionally, particle grinding will reduce particle size of the product matter being mixed, which is often an undesired side effect of mixing.

Another potential problem with horizontally mounted drum mixers involves the cleanliness and complete emptying of the drum mixer. The discharge chute for drum mixers is often raised above the lowest point in the drum mixer. Raising the discharge chute allows for gravitational discharge into a container which is placed below the discharge chute. Complete emptying of the drum mixer, which is necessary both to avoid product waste and for cleaning of the drum mixer, is only accomplished if all the product matter in the mixer is adequately raised to the discharge chute.

SUMMARY OF THE INVENTION

The present invention is a rotary drum mixing system which mixes product matter in a particulate form and a seal configuration for the rotary drum mixing system. The rotary drum mixing system includes a rotatable open-ended drum with a scoop section, and a stationary hood enclosing the open end of the drum/scoop section combination. In the preferred embodiment, the scoop section has turbine or scoop blades which are radially enclosed by a peripheral wall and axially enclosed by an end wall, and no stationary circumferential surface is presented to the product matter being mixed. The stationary hood includes an outer face portion which covers the end wall of the scoop section and a peripheral portion which covers the peripheral wall of the scoop section, but neither the outer face portion nor the peripheral portion of the stationary hood contact product matter.

A seal assembly is preferably positioned toward the inner diameter of the scoop blades. The seal assembly preferably includes a seal hoop mounted on the inner diameter of the scoop blades, a stationary seal member positioned radially inward and against the seal hoop, and a bladder positioned against the seal member. When the bladder is inflated, it pushes the seal member radially outward against the seal hoop, forming a seal for inhibiting fine particles of product matter from passing between the drum assembly and the stationary hood along the seal hoop.

A housing on the stationary hood retains the seal member and the bladder in an annular cavity which is open to the seal hoop with the cavity being defined by a first annular side wall, an annular outer wall spaced from the annular ring and a second annular side wall spaced from the first side wall. One of the annular side walls is readily removable to allow access to the seal member and the bladder.

While the above-identified drawing figures set forth preferred embodiments, other embodiments of the present invention are also contemplated, some of which are noted in the discussion. In all cases, this disclosure presents the illustrated embodiment of the present invention by way of representation and not limitation. Numerous other minor modifications and embodiments can be devised by those skilled in the art which fall within the scope and spirit of the principles of this invention.

DETAILED DESCRIPTION OF THE PREFERRED EMBODIMENTS

In addition to the present invention, the drawings and particularly FIGS. 1–4 illustrate generally a rotary drum mixing system such as taught in U.S. Pat. Nos. 3,269,707, 3,552,721, 3,897,934, and 5,415,356 and in U.S. patent application Ser. No. 08/120,681, filed Sep. 13, 1993, which are assigned to the assignee of the present application, all of which are hereby incorporated herein by reference.

Figure 1:
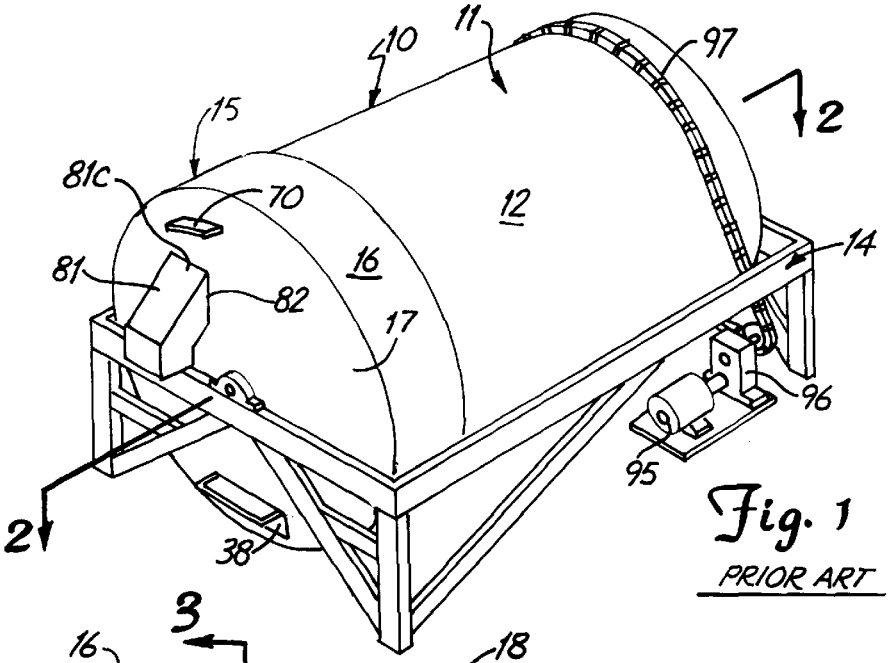
Fig. 1 PRIOR ART
FIG. 1 is a perspective, somewhat schematic view of a particulate material mixing machine of the prior art.
Figure 2:
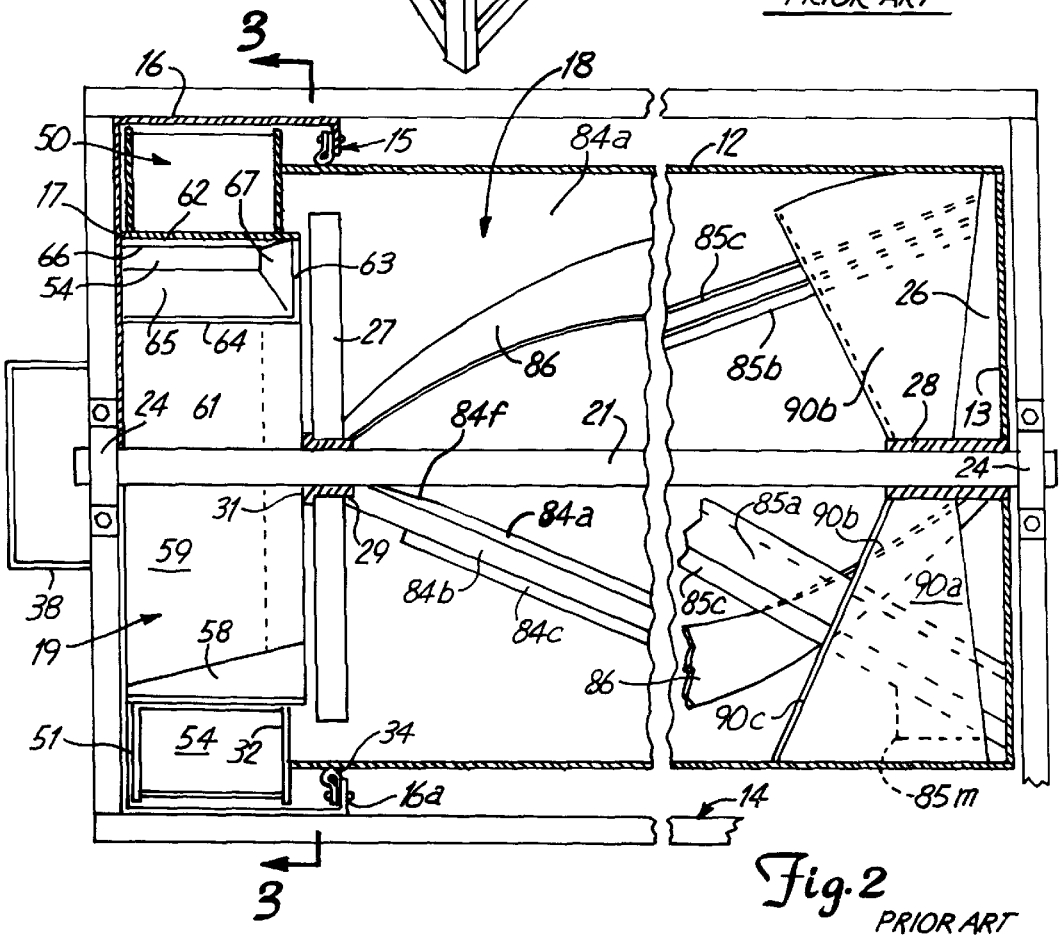
Fig. 2 PRIOR ART
FIG. 2 is an enlarged vertical transverse sectional view of the particulate material mixing machine of the prior art generally taken along the line and in the direction of arrows 2—2 of FIG. 1 and 2—2 of FIG. 3 with a central portion broken away, said view more clearly illustrating the mechanism for transferring material in the stationary hood into the rotary drum and for positively conveying the material to a substantial elevation where it is selectively discharged or permitted to descend to the general level of the material in the drum and also the structure for causing the material in the drum to be more thoroughly mixed and directed into the transfer mechanism.

Referring in particular to FIGS. 1 and 2 there is illustrated a perspective view and a longitudinal horizontal cross-sectional view of the particulate material mixing machine, generally designated 10, of the prior art. The apparatus 10 includes a large cylindrical drum 11 having a tubular outer wall 12 and a rear end wall 13 mounted to revolve on its axis and supported on a shaft 21. The tubular outer wall 12 and the rear end wall 13 define a main mixing chamber 18. The shaft 21 at either axial end is mounted on appropriate portions of the frame members of the frame generally designated 14, by mounting members 24.

There is provided a stationary hood, generally designated 15, having a tubular outer wall 16 and a stationary end wall 17, the tubular outer wall 16 being of a substantially larger diameter than tubular wall 12 and concentrically located relative to the front axial end-portion of the drum 11. As may be noted from FIGS. 2 and 4, a portion of a tubular wall 16 overlays a portion of the tubular drum wall 12. Extending axially through the drum 11 and at one end projecting through the end wall 13 and at the opposite end through the end wall 17 is the shaft 21. Rotatably mounted on the shaft 21 adjacent the end wall 17 is a mounting member 28. A plurality of radial spider members 26 at their one ends are fixedly connected to the member 28 and at the opposite ends to drum wall 12. The adjacent edges of the spider members 26 may also be welded to the drum end wall 13. At the opposite axial end of the drum wall 12 there is provided a plurality of radially extending spider members 27 that at the one ends are welded to the annular member 29 which mounts said spider members 27 on the shaft and at the opposite ends are welded to the drum wall 12. As may be noted from FIG. 4, the spider members 27 are located a substantial distance axially rearwardly of the hood end wall 17. If shaft 21 is stationary as disclosed in U.S. Pat. No. 3,269,707, then members 28, 29 are bearing members while if the shaft 21 is rotatably mounted then members 28, 29 may be welded to the shaft 21.

An annular mounting flange 32 is welded to the forward edge of the tubular wall 12. The outer diameter of the flange 32 is slightly less than the inner diameter of the hood tubular wall 16; and the inner diameter is substantially larger than the maximum diameter of member 29 but substantially less than the inner diameter of the drum tubular wall 12. Thus member 29 and flange 32 provide an annular opening 31, other than for spider members 27, to permit axial movement of material into and out of the confines of the main mixing chamber 18.

Figures 3, 4:
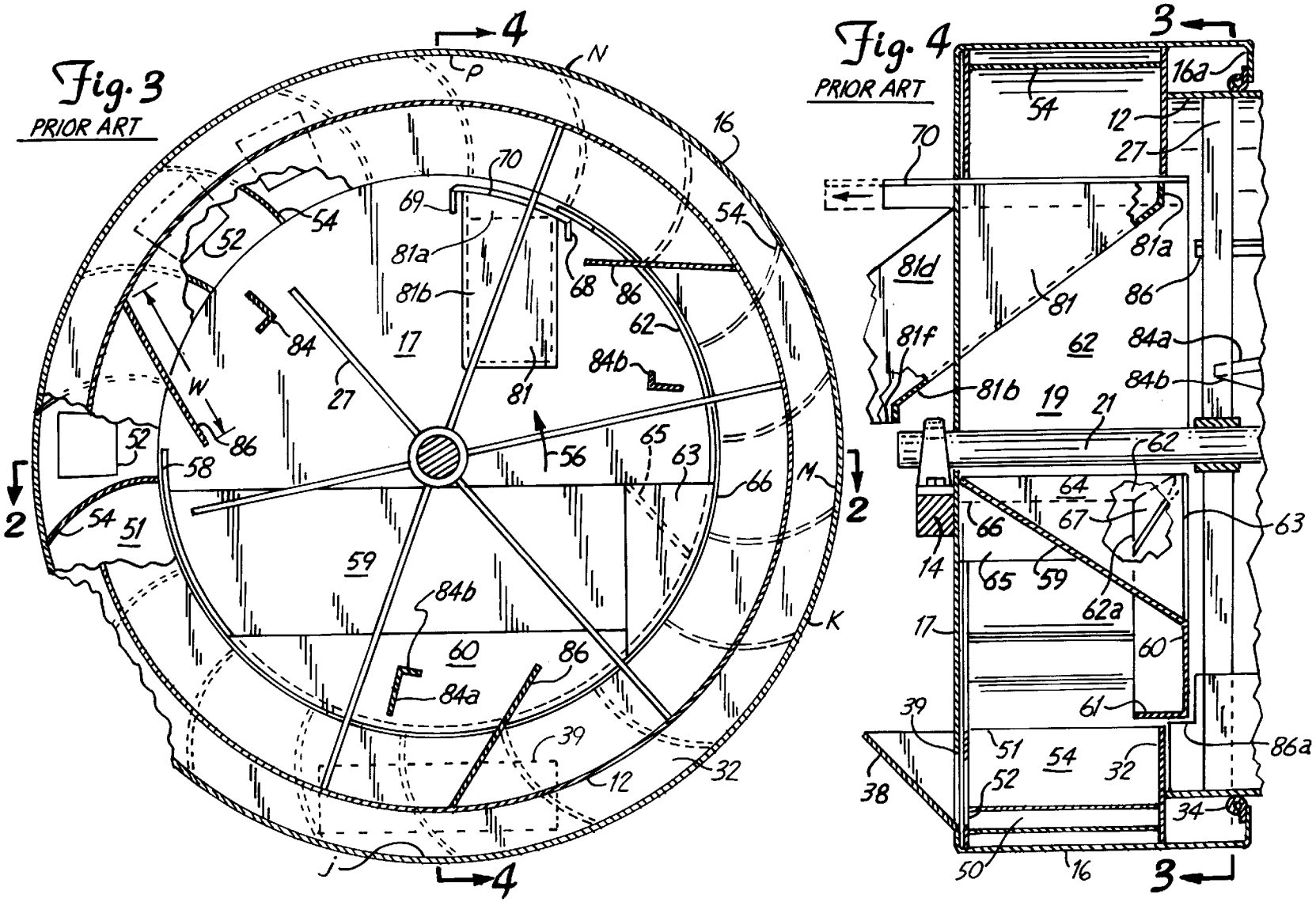
Fig. 4 PRIOR ART
Fig. 3 PRIOR ART
FIG. 3 is an enlarged vertical transverse sectional view of the particulate material mixing machine of the prior art generally taken along the line and in the direction of the arrows 3—3 of FIG. 4 to more fully illustrate the transfer mechanism including mechanism for controlling the discharge of material, portions of said view being broken away at various axial positions to more fully illustrate other portions of the transfer mechanism.
FIG. 4 is an enlarged, fragmentary, vertical longitudinal cross-sectional view of the particulate material mixing machine of the prior art generally taken along the line and in the direction of arrows 4—4 of FIG. 3, the control door being shown in the solid lines in a position for preventing flow of material into the discharge chute, and in dotted lines for permitting material elevated by the scoops to descend into said chute.
Figure 5:
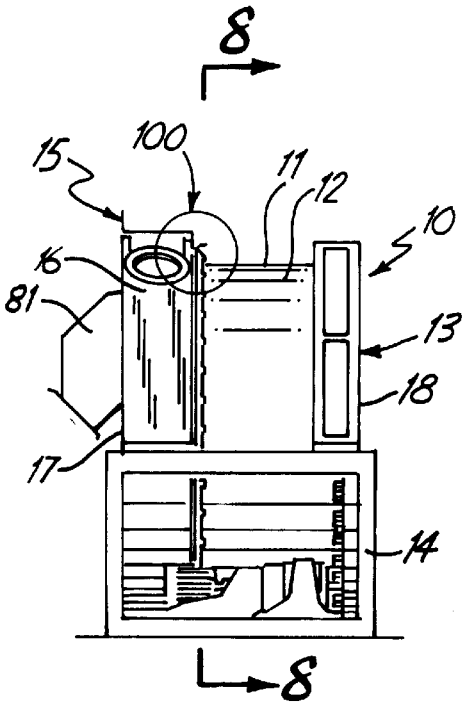
FIG. 5 is a side elevational view of a first seal assembly of a rotary drum mixing system in accordance with the present invention.

Referring to FIG. 4, it is to be noted that the hood 15 has an inwardly extending annular flange 16*a* located axially opposite the mounting flange 32 from the hood end wall 17, a resilient annular seal member 34 being mounted on said annular flange 16*a* to bear against the tubular outer wall 12 of the drum 11 to form a seal therewith.

In order to permit loading the drum 11 while it is rotating, a chute 38 is welded to the hood end wall 17 for directing material downwardly through the rectangular opening 39 provided in said end wall 17 adjacent the lowermost axially extending portion of the hood tubular wall 16. The lowermost horizontal edge of the opening 39 is located at a lower elevation than the lowermost portion of the tubular drum wall 12. In order to permit particulate material being moved through the chute 38 and port 39, and thence transferred into the main mixing chamber 18 while the said drum 11 is rotating and at the same time to selectively permit discharge of material, there is provided the transfer mechanism or turbine section generally designated 50 that includes control mechanism which will be described hereinafter.

The transfer mechanism 50 includes the aforementioned annular mounting flange 32 and a second annular mounting flange 51 that has substantially the same inside and outside diameters as that of flange 32. Mounting flange 51 is fixedly attached to flange 32 and retained in axial spaced relationship by the structure to be described hereinafter. However, at this time it is to be noted that the mounting flange 51 is retained axially adjacent the hood end wall as shown in FIG. 4 and that it is of a greater radial dimension than the maximum radial distance to the lower edge of the inlet port 39. Further the inner peripheral edge of flange 51 is located radially more adjacent the shaft 21 than any portion of the peripheral edge of port 39. In order to permit the flow of the material from port 39 onto the hood tubular wall in the space axially between the flanges 32 and 51, flange 51 has a plurality of circumferentially spaced cutouts 52.

A plurality of scoop members 54 are welded at axially opposite edges to flanges 32 and 51 respectively in circumferentially spaced relationship to extend completely around the circumference of the hood 15 within the confines of said hood 15. The front section of the mixer 10, including the scoops 54 and flanges 32 and 51, may be referred to as the turbine chamber or scoop chamber 19. As may be noted from FIG. 3, each of the scoop blades 54 is arcuate in transverse cross section. The adjacent portions of the mounting flanges 32, 51 form end walls for the scoop members. Each of the scoops 54 opens in the direction of rotation of the drum which is indicated by arrow 56.

Secured to the hood end wall 17 and made up of a plurality of joined together sections is a baffle, said baffle including an arcuate section 58 that extends arcuately adjacent to the inner circumferential edges of the scoops 54, has an arcuate edge joined to the hood end wall 17, and has a terminal axially extending top edge at about the same elevation as the axis of rotation of the drum. A generally planar baffle section 59 has its front edge joined to the hood end wall 17, is inclined downwardly at a relatively steep angle in a direction toward the rear wall 13, and has its rear edge substantially more closely axially adjacent to the rear wall 13 than the mounting member 32, and has one edge joined to the lower edge of arcuate section 58. The rear edge of inclined section 59 is at a lower elevation than shaft 21. A vertical, transverse section 60 has its upper edge joined to the rear edge of section 59 and has a circumferential edge joined to the rear edge of arcuate flange section 61. Section 61 has an outer radius of curvature slightly less than the inner radius of curvature of mounting member 32, is closely adjacent an arcuate portion of mounting member 32, and extends distances both axially substantially more closely adjacent and more remote of the hood end wall than mounting member 32. The axial length of flange section 61 that extends on each axial side of mounting member 32 is many times greater than the clearance between the flange section 61 and the mounting member 32. One transverse edge of flange section 61 is joined to section 58 and the opposite transverse edge is joined to a transverse edge portion of an arcuate baffle section 62 at about the elevation of the juncture of sections 59, 60. One arcuate edge of section 62 is joined to the hood end wall 17 while the opposite arcuate edge is spaced about the same distance from the hood end wall 17 as section 60. The axially extending edge of section 62 that is opposite flange section 61 in part terminates above the discharge chute 81. Further, section 62, flange section 61 and arcuate section 58 have substantially the same radii of curvature.

In order to permit material in the main mixing chamber 18 being fed into the path of movement of the scoops 54, there is provided a hopper that has a vertical axially extending plate 64. Plate 64 is triangular and has one edge joined to inclined baffle section 59, a vertical second edge, and a third top edge at the elevation of the front edge of section 59. A second hopper plate 63 has a vertical first edge joined to the second edge of plate 64 and the vertical edge of section 60, a second top edge at the elevation of the top edge of plate 64 and an arcuate third edge joined to the adjacent portion of the edges of flange section 61 and arcuate section 62 that are remote from the hood end wall 17. Plate 63 is parallel to the hood end wall 17 and perpendicular to plate 64.

An inclined planar plate 65 is joined to and extends between the hood end wall 17 and plate 63, has a top edge adjacent the top edge of plate 64 and has a bottom edge that in part is extended along the juncture of baffle sections 61, 62. Plate 65 extends parallel to the axis of rotation of the drum and is inclined downwardly and away from the vertical plane of said axis. The lower corner portion of baffle section 62 that is adjacent the hood end wall 17 is cut away to, in conjunction with the bottom edge of plate 65, provide a hopper outlet 66 that opens into the path of movement of the scoops. The axial length of the cutout is the same as the spacing of flange section 61 from the hood end wall, the arcuate edge portion 62*a* of section 62 forming one edge of the hopper outlet. A second plate 67 has a top edge adjacent the top edge of plate 63 and is inclined downwardly toward the hood end wall 17. Plate 67 has a second edge joined to the adjacent portion of plate 65, an arcuately curved third edge joined to baffle section 62 along edge 62*a,* and a fourth edge joined to baffle section 62 and extending between the first and third edges. Plates 65, 67 are inclined at angles that the particulate material normally will flow freely downwardly along the surface thereof. Further plates 63, 64 are joined to the adjacent portions of baffle sections and the inclined plates; and serve as reinforcing members.

The top edges of plates 65, 67 along with the portions of baffle section 62 and the hood end wall 17 at the same elevation provide a hopper inlet, the hopper inlet being located horizontally on the opposite side of shaft 21 from baffle section 58 and at a slightly lower elevation than shaft 21. Further, the hopper inlet is located in a horizontal direction more remote from shaft 21 than the discharge chute inlet and at a substantially lower elevation. The hopper outlet is located at a substantially higher elevation than port 39, and angularly between port 39 and the inlet of discharge chute 81 in the direction of arrow 56 angularly in advance of port 39.

An arcuate discharge closure member (door) 70 is provided to selectively block the discharge chute inlet. As may be noted from FIG. 3, the trailing edge of the closure member underlies the leading edge portion of baffle section 62. The closure 70 is slidably extended through an arcuate slot provided in the hood end wall, is of an axial length to, in the closed solid line position of FIG. 4, be closely adjacent and underlie a portion of mounting flange 32, and has an axially extending end portion located exteriorly of the hood end wall 17. The closure 70 may be provided with handles, or appropriate lever mechanism connected thereto, for moving the closure between the solid line position of FIG. 4 and the withdrawn dotted line position to at least partially unblock the discharge chute inlet. In order to mount the closure 70 for slidably movement, there are provided bracket members 68 and 69 at opposite longitudinal edges of the closure 70, said brackets having shoulders against which said closure abuts.

The chute 81 has an inclined bottom wall 81*b* that extends axially adjacent the spider members 27 and a top wall 81*c* that extends axially slightly inwardly of the end wall 17. The chute also includes sidewalls 81*d.* To the angular advanced sidewall there is joined an upwardly extending rectangular portion and to the bottom wall there is joined an upright arcuate portion 81*e.* The last two mentioned portions extend to a higher elevation than the maximum elevation of the bottom wall to preclude a substantial amount of material that moves over the leading edge of baffle section 62 being carried by inertia beyond the confines of the discharge chute 81. The chute 81 is mounted to have an intermediate portion extend through the port 82 formed in the hood end wall 17, the inner portion being located within the confines of the hood 15, and the remaining portion extending forwardly of the hood end wall 17. The chute 81 has the discharge opening 81*f* which is located at approximately the same elevation as the shaft 21.

Various structures may be used to mix material within the main mixing chamber 18 and to facilitate movement of material from within the main mixing chamber 18 to a location axially between mounting flanges 32 and 51. U.S. Pat. Nos. 3,553,721 and 3,269,707 describe mixing blades 86, baffles 90, and troughs 84, 85 particularly suited for this purpose.

Suitable power actuating mechanism for the drum 10 is diagrammatically shown in FIG. 1 and may comprise an electric motor 95 operably connected through suitable speed reduction mechanism 96 to a sprocket, chain and a ring gear 97 affixed on the outer periphery of the tubular wall 12 of the drum 11. Thus, the drum 11 may be rotated at a suitable speed, usually on the order of 2 to 5 r.p.m. and preferably at about 3 r.p.m., in the direction of the arrow 56 in FIG. 3.

The structure of the prior art drum mixer having been described, the operation thereof will now be briefly set forth. Assuming that the drum is in an emptied condition, and being rotated and closure member 70 is closed, the particulate material to be mixed is dumped into chute 38 where under the action of gravity it flows through the hood inlet port 39 and thence through the cutouts 52 of the mounting flange 51 that are located adjacent to and open to the inlet port 39. The material flows through the cutouts under the action of the gravity to the bottom of the hood tubular wall 16 to be located adjacent position j (0° drum rotary position) axially between flanges 32, 51 and circumferentially between an angularly adjacent pair of scoops 54. As the drum rotates to move a scoop 54 from position j angularly in the direction of rotation of the drum (arrow 56) to a more elevated condition, the material is precluded from falling into the confines of the drum wall 12 by mounting member 32 and baffle sections 60, 61. As a scoop 54 is angularly advanced from a position generally in the area of position j, the material being moved over the hood tubular wall moves radially inwardly over the scoop 54 toward the radially inner edge thereof. When the scoop 54 has been advanced to position k (about 65° drum rotary position), the inner edge of the scoop 54 is adjacent the lower edge of plate 65; and as the scoop 54 advances past the hopper inlet, a small quantity of material may fall over the inner edge of the scoop 54 into the path of movement of the following scoop 54. At the time the scoop 54 has been advanced to position m (about 80° drum rotary position), the inner edge of the scoop is adjacent the upper edge of the hopper outlet, and thence as the scoop continues to be rotated in the direction of arrow 56, the material is moved over the surface of baffle section 62.

As the scoop advances the material angularly to position n (about 165° drum rotary position), it moves over closure member 70, provided said closure member is in a closed position, and thence to position p (about 180° drum rotary position) where the material descends to fall upon baffle section 59 and then slides thereover to fall within the main mixing chamber 18.

As material falls onto drum wall 12, the spiral blades 86 will cause such material to flow toward mounting member 32 and be elevated to fall off the ends of the spiral blades into the hopper inlet. However, due to the axial length of flange section 61, no significant amount of material passes between the clearance space between said flange section 61 and mounting member 32.

The material flowing into the hopper inlet passes through the hopper outlet onto a scoop 54 carrying material that had flowed through port 39 and cut out 52; or if the scoop 54 does not have additional carrying capacity, the hopper fills up and material flows over the top edges of the hopper. However due to the size of the cutouts 52 and the fact that at least one scoop 54 is always located angular between angularly adjacent edges of port 39 and the hopper outlet, an insufficient amount of material builds up on the lower portion of the hood wall 16 whereby sufficient material would flow under annular member 32 to have a material buildup to the elevation of the lowermost part of seal 34.

This precludes undue wearing of the seal such as would occur if there were a buildup of material adjacent the seal 34. As additional material is fed through the chute 38 and transferred into the main mixing chamber 18 in the aforementioned manner, the level builds-up in the drum adjacent mounting member 32 and baffle section 60 sufficiently to be of a greater depth than the height of the mixing blades at their lowermost angular position and accordingly falls over the top of the mixing blades and gradually works to the end 13 of the drum. At this time the troughs 85 direct (convey) material forwardly to cause the material to become thoroughly mixed. Also troughs 84 aid in mixing the material. This procedure will continue until the drum is loaded, all the time the material being continuously mixed.

After loading through chute 38 is discontinued, the scoops remove substantially all the material on hood wall 16 adjacent port 39 whereby the material is transferred into the drum. Thereafter, mixing may be continued with material flowing through the hopper being elevated and then the elevated material descending onto baffle section 59 at angular position p. However, the scoops angularly between the hopper outlet and port 39 prevent any significant flow of material that has passed through the hopper moving generally in a direction opposite arrow 56 to a position adjacent port 39, i.e., the scoops at this time keeping the lowermost portion of the hood substantially free of material.

After mixing is complete, the closure 70 is at least partially opened whereby material elevated to position n is free to flow into the discharge chute inlet axially between the closure and chute portion 81*e*. If the closure is only partially open, some of the material elevated to position n will be discharged through chute 81 and the rest will be moved over the closure to position p to descend onto baffle section 59.

The material falling through the inlet of the chute 81 passes through the outlet 81*f* into a bag or a suitable receptacle. The spiral blades continuously feed material axially forwardly and elevate the material to pass through the hopper to be subsequently moved by the scoops to an elevated position to be discharged through chute 81. All during the filling of the mixer 10 and the mixing of the material, material radially adjacent the front edges of troughs 84 can move relative to said front edges in a direction opposite arrow 56, i.e., not advanced angularly as fast as the trough. After the drum has been filled to a level that is about the same as the radial spacing of the front edges of troughs 84, from the tubular wall 12, material is moved by the troughs 84. About the time the drum is one-third filled, material builds along the tubular wall 12 in the direction of arrow 56 to a sufficient height that the front end portions of troughs 84 will "scoop up" material which, for the most part slides rearwardly along the trough as the drum 11 rotates. However, when the drum 11 is in a near empty state, the material radially adjacent a trough 84 front edge when the trough is in its lower angular position is not axially moved rearwardly but rather passes therebeneath to be axially moved forwardly by the next angularly rearward mixing blade.

The emptying process is continued until the drum is emptied. Then the closure 70 is moved to a closed position to ready the apparatus for mixing another batch of material.

FIGS. 5–8 illustrate a seal assembly, designated generally at 100, in accordance with the present invention, to replace the prior art seal assembly 34 of the drum mixer 10. The seal assembly 100 inhibits the passing of product matter from between the stationary hood 15 and the drum 11. The seal assembly 100 includes a housing 102 having an annular base member 104, an annular compression member 106 and an annular securing member 108 with the base member 104, the compression member 106 and the securing member 108 defining an annular cavity 110 open to the peripheral wall 12 of the drum 11. The base member 104 and the compression member 106 are fixedly attached to the annular flange 16*a* on the stationary hood 15 and fixedly attached to each other by suitable fastening means such as welding whereby the annular base member 104 and the compression member 106 completely encircles the main mixing chamber 18 of the drum 11. The annular securing member 108 also encircles the main mixing chamber 18 and is removably attached to the compression member 106 by a plurality of suitable, spaced-apart bolts 114 such that the securing member 108 can be removed from the compression member without removing the compression member 106 from the annular flange 16*a* of the stationary hood 15 thereby exposing the annular cavity 110.

The seal assembly 100 further includes an inflatable bladder 116 and a seal member 118. The inflatable bladder 116 is positioned within the annular cavity 110 of the housing 102 defined by the base member 104, the compression member 106 and the securing member 108 such that the inflatable bladder 116 is supported on three sides. Therefore, as the inflatable bladder 116 inflates, the inflatable bladder 116 is restricted from expanding in all directions except the direction radially inward towards the drum assembly 16. The inflatable bladder 116 is preferably constructed from a flexible or elastic hose, such as rubber or the like.

The inflatable bladder 116 includes an inflation line 120 extending through an aperture 122 in the compression member 106 and connected to a pressurized, compressed fluid source 124. When inflation of the inflatable bladder 116 is desired such as prior to or during operation of the drum mixer 10, the pressure source 124 is activated and pressurized fluid travels through the inflation line 120 and into the inflatable bladder 116 thereby inflating the inflatable bladder 116. Operation of the inflatable bladder 116 including the inflation thereof will be further discussed below.

The seal member 118 is also positioned within the annular cavity 110 between the inflatable bladder 116 and the drum peripheral wall 12. The seal member 118 preferably comprises a flexible strip of TEFLON-impregnated woven fabric packing available from W. L. Gore & Associates, Inc., Elkton, Md., under the name TFE Filament Packing #1367-S. However, any suitable low-friction material is within the scope of the present invention.

A plurality of screws 126 are preferably inserted through apertures 128 in the annular securing member 108 and into the seal member 118 about ¼ inch to ½ inch. The screws 126 are preferably equally spaced about the annular distance of the seal member 118 with a distance of between approximately six inches to eighteen inches between each screw 126 depending on the diameter of the drum peripheral wall 12. The screws 126 effectively prevent the seal member 118 from rotating with the drum 11.

An annular ring or seal hoop 130 constructed preferably from carbon steel, stainless steel or a ceramic strip is welded or secured to the outer main wall 12 of the drum 11 between the housing 102 and the drum peripheral wall 12 such that upon rotation of the drum 11, the housing 102 and the seal hoop 130 do not contact each other. The seal hoop 130 includes a substantially smooth, mirror-like machined outer surface 132. The outer surface 132 is preferably manufactured to have a concentricity or circularity which varies by an amount less than approximately 0.0030 inch. As the drum 11 rotates, the seal member 118 travels along the seal hoop 130 creating a sealing surface which inhibits fine, submicron particles of product matter from passing between the seal hoop 130 and the seal member 118.

This seal assembly 100 of the present invention works very effectively for fine particles and at various operating temperatures (−100 degrees to 500 degrees Fahrenheit) to inhibit the travel of product matter out of the mixing system 10 and the travel of contaminants into the mixing system 10.

To replace or perform maintenance on the inflatable bladder 116 and the seal member 118 of the seal assembly 100 of the present invention and thereby effectively seal product matter within the mixing assembly 10, the mixing assembly 10 is turned off and disconnected from its power source. Once the drum 11 has stopped all rotation, the bolts 114 securing the securing member 108 to the compression member 106 are removed and set aside. The securing member 108 is then carefully moved away from the base member 104 and the compression member 106 toward the main rear wall 13 of the drum 11. Once the securing member 108 has been moved away from the base member 104 and the compression member 106, the entire inflatable bladder 116 and seal member 118 are easily accessible for replacement repair or maintenance.

It should be noted that to expose the annular cavity 110 of the housing 102 of the seal assembly 100 of the present invention, it is not necessary for any portion of the housing 102 (i.e., the base member 104, the compression member 106 or the securing member 108) to be removed completely from the drum 11. By disconnecting the bolts 114 and simply moving the securing member 108 toward the main rear wall 13, the annular cavity 110 is exposed and the inflatable bladder 116 and the seal member 118 are readily accessible for inspection, replacement and/or repair.

Figure 7:
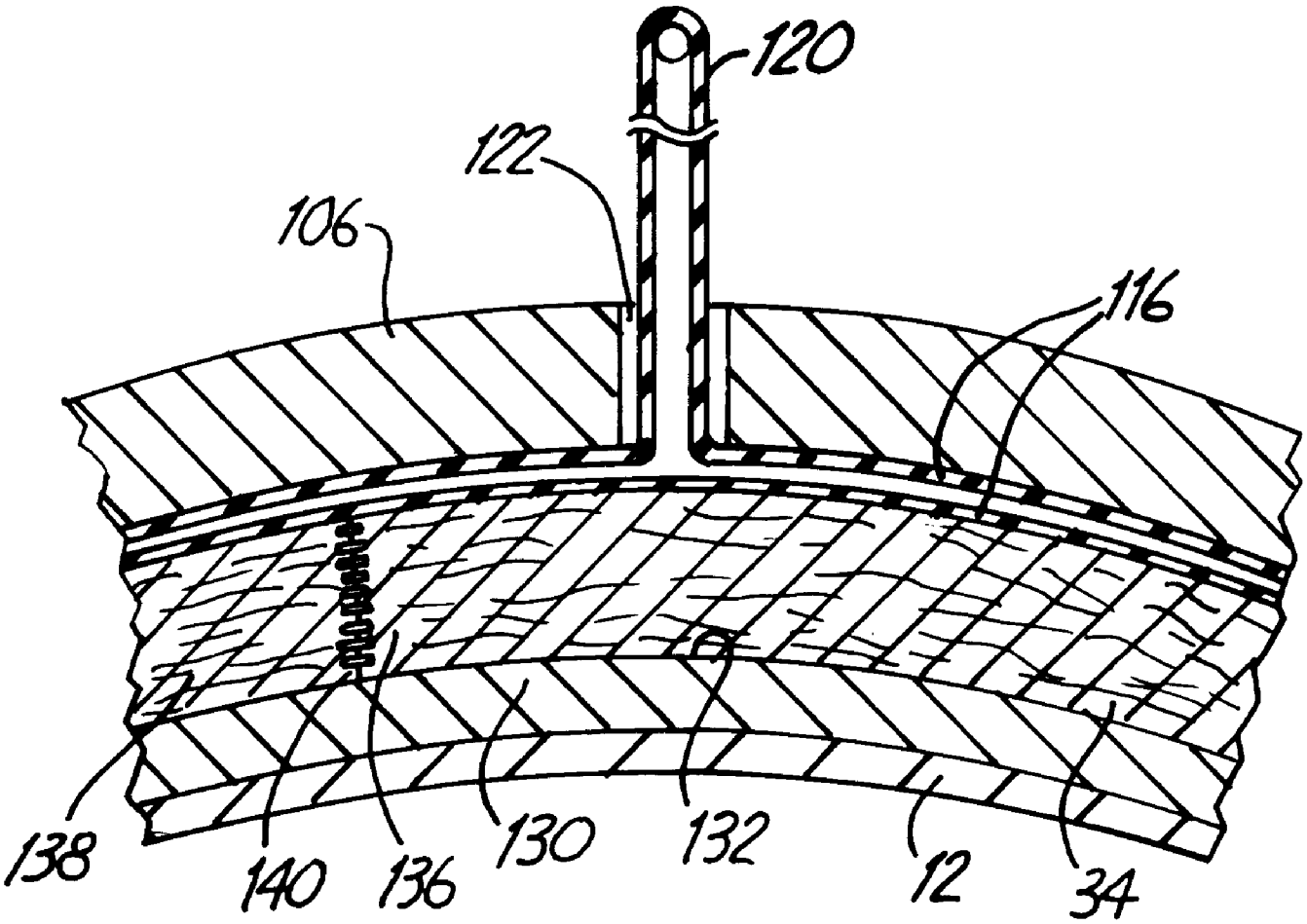
FIG. 7 is an enlarged sectional view of a portion of the first seal assembly, as taken along line 7—7 of FIG. 6, and as enlarged from area 7 in FIG. 8.

To reconstruct the seal assembly 100 of the present invention, the seal member 118 is positioned such that the seal member 118 rests upon the outer annular surface 132 of the seal hoop 130 and against an inner surface 134 of the base member 104. As shown in FIG. 7, the ends 136, 138 of the seal member 118 are sewn together by fibers 140 constructed of the same material as the seal member 118 or fastened together by other suitable fastening means thereby creating a continuous fabric strip about the circumference of the seal hoop 130. The inflatable bladder 116 is placed upon the seal member 118 and against the inner surface 134 of the base member 104 and an inner surface 142 of the compression member 106. The inflation line 120 is reinserted through the aperture 122 of the compression member 106 and connected to the pressure source 124. The securing member 108 is positioned such that an inner surface 144 of the securing member 108 abuts the inflatable bladder 116 and the seal member 118, thereby enclosing the inflatable bladder 116 and the seal member 118 within the annular cavity 10. The securing member 108 is then fastened into place by the bolts 114 and the mixing assembly power is reconnected.

Upon the seal assembly 100 of the present invention being reconstructed, the pressure source 124 can be activated thereby causing compressible fluid to fill the inflatable bladder 116 through the inflation line 120. As the fluid enters the inflatable bladder 116, the inflatable bladder 116 inflates and expands in the direction radially inward toward the outer annular surface 132 of the seal hoop 130 on the drum peripheral wall 12. A pressure regulator 146 regulates the amount of pressure to between approximately 10 p.s.i. to 30 p.s.i., although lower pressure, i.e., 5 p.s.i. and higher pressure, i.e., 55 p.s.i., are within the scope of the present invention. A check valve 147 may be placed in the inflation line 120 to prevent deflation of the inflatable bladder 116 should the pressure source 124 happen to fail. The expansion of the inflatable bladder 116 urges the seal member 118 against the surface 132 of the seal hoop 130 and creates a seal between the seal member 118 and the seal hoop 130, thereby inhibiting fine, submicron particles of product matter from passing between the drum peripheral wall 12 and the stationary hood 15 along the seal hoop 130.

As the drum 11 is rotated, the seal member 118 will ultimately tend to conform to the surface 132 of the seal hoop 130 and the thickness of the seal member 118 will decrease. By having the pressure regulator 146 maintain the fluid within the inflatable bladder 116 at a constant pressure, the inflatable bladder 116 will continue to urge the seal member 118 against the seal hoop 130 even as the seal member 118 migrates or conforms to fill the opening between the housing 102 and the seal hoop 130. Therefore, with the seal assembly 100 of the present invention, an effective seal is created and maintained and the frequency of replacing the seal member 118 is reduced, and the ease of its replacement, when necessary, has been substantially improved.

The seal assembly 100 of the present invention effectively seals about rotary drums having diameters of up to and including 13 feet 2 inches. These drums rotate at between approximately three to seven revolutions per minute.

A distinct advantage of the seal assembly 100 of the present invention is that upon inflation of the bladder to the desired pressure, the annular base member 104 and the securing member 108 are only approximately 1/16 inch above the outer surface of the seal hoop 130. By maintaining such a small opening, cleaning the area about the seal assembly 100 is much easier due to the decreased space for product to enter the area thereby reducing any contamination which could be overlooked between batches. Thorough cleaning between batches is a necessity for high purity applications such as when mixing or producing pharmaceuticals or food destined for human consumption.

Figure 11:
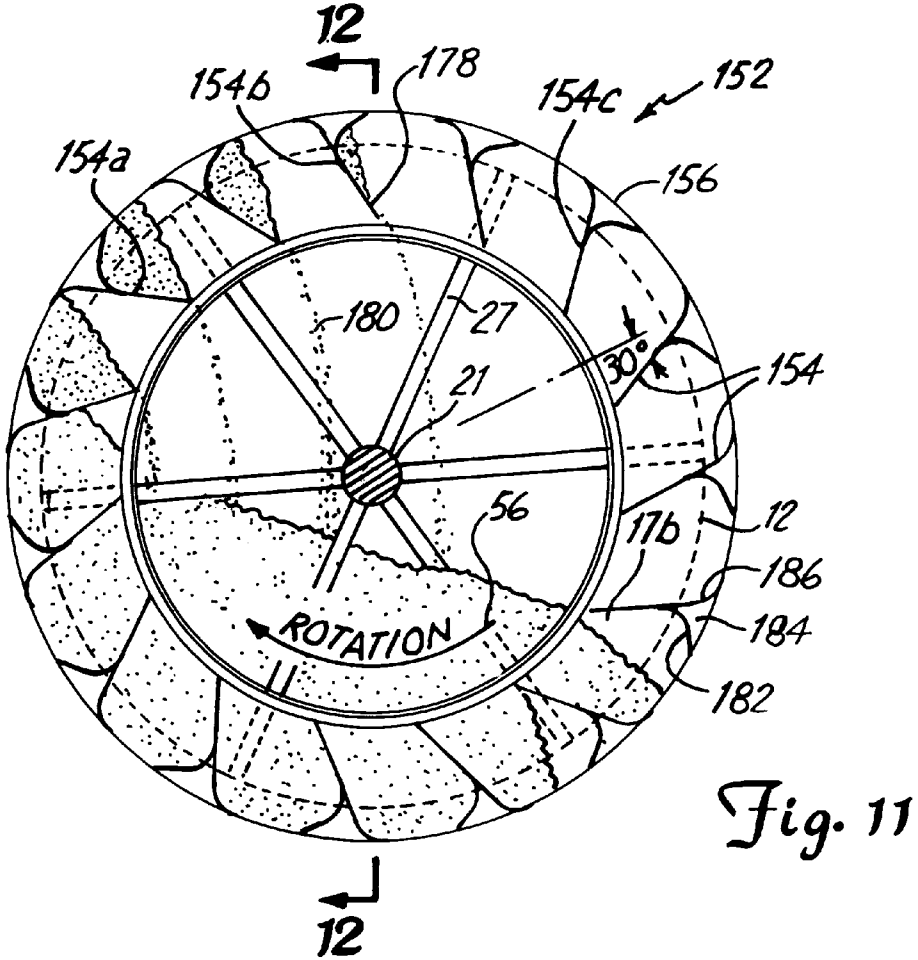
FIG. 11 is a cross-sectional view of the scoop section of the second rotary drum mixer taken along line 11—11 of FIGS. 10 and 12.

FIGS. 9–12 show an alternative configuration of a drum mixer 150 of the present invention. The drum mixer 150 is similar in many respects to the prior art drum mixer 10 shown in FIGS. 1–4. In FIG. 11, the mixing elements 84, 85, 86, 90 of the main mixing chamber 18 have been left out for simplification of the drawing, but the radially extending spider members 27 which are used to position the drum 11 on the center shaft 21 are still shown. It should be appreciated that the main mixing chamber 18 can be designed as necessary for best mixing of the particulate material, including the mixing elements 84, 85, 86, 90 shown in the prior art mixer 10.

Figure 12:
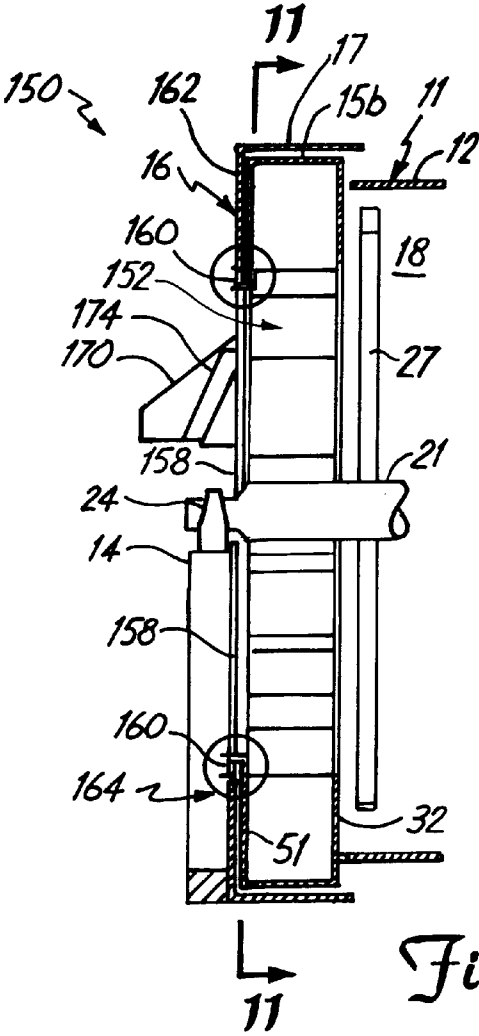
FIG. 12 is a cross-sectional view of the scoop section of the second rotary drum mixer taken along line 12—12 of FIGS. 9 and 11.

Drum mixer 150 has a configuration for the scoop chamber 152 which is very different in several ways from scoop chamber 19 of drum mixer 10. As best seen in FIGS. 11 and 12, the structure of the scoop blades 154 is significantly modified from scoop members 54. The scoop blades 154 are still attached between the first annular mounting flange 32 and the second annular mounting flange 51. However, in drum mixer 150, the outer periphery of the scoop blades 154 is enclosed by a circumferential wall 156. The circumferential wall 156 is attached at its edges to the outer edges of the annular mounting flange 32 and the second annular mounting flange 51, creating a peripheral enclosure for the scoop chamber 152 which rotates with the drum 11. This is in contrast to the prior art mixer 10, wherein the outer periphery of the scoop blades 54 were necessarily open to the stationary peripheral wall 16 of the stationary hood 15.

Figure 9:
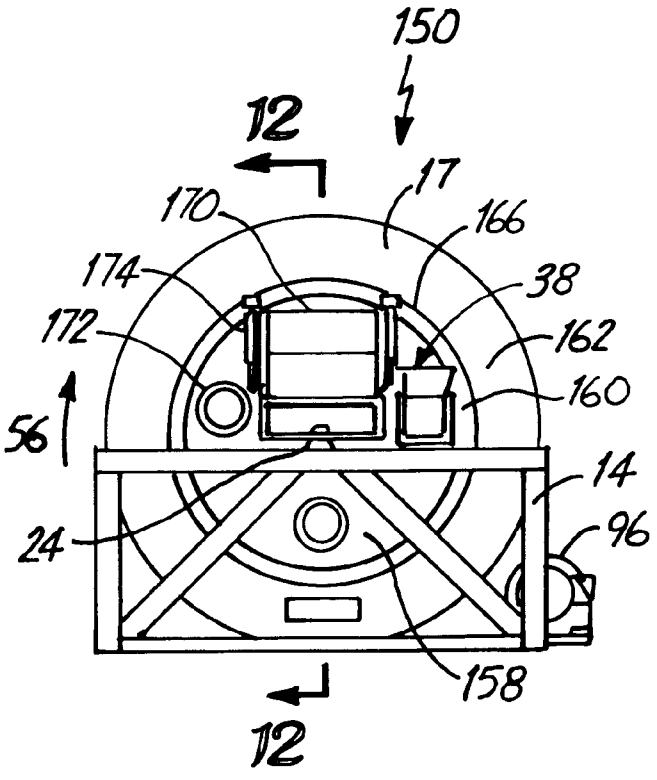
FIG. 9 is a front elevational view of a second rotary drum mixer in accordance with the present invention.

As best shown in FIG. 9, the hood end wall 17 includes a central portion 158, a seal cover ring 160, and an outer portion 162. This is in contrast to the prior art mixer 10, wherein the hood end wall 17 was provided by a single sheet of material. As best shown in FIG. 12, the seal assembly 164 of this embodiment is moved both axially and radially, to seal between the second annular mounting flange 51 and the central portion 158 of the hood end wall 17. The seal assembly 164 is moved axially to the front face of the mixer 150, into axial alignment with the second annular mounting flange 51. The seal assembly 164 is moved radially inward to the inner diameter of the second annular mounting flange 51 and the scoop blades 154.

Figure 13:
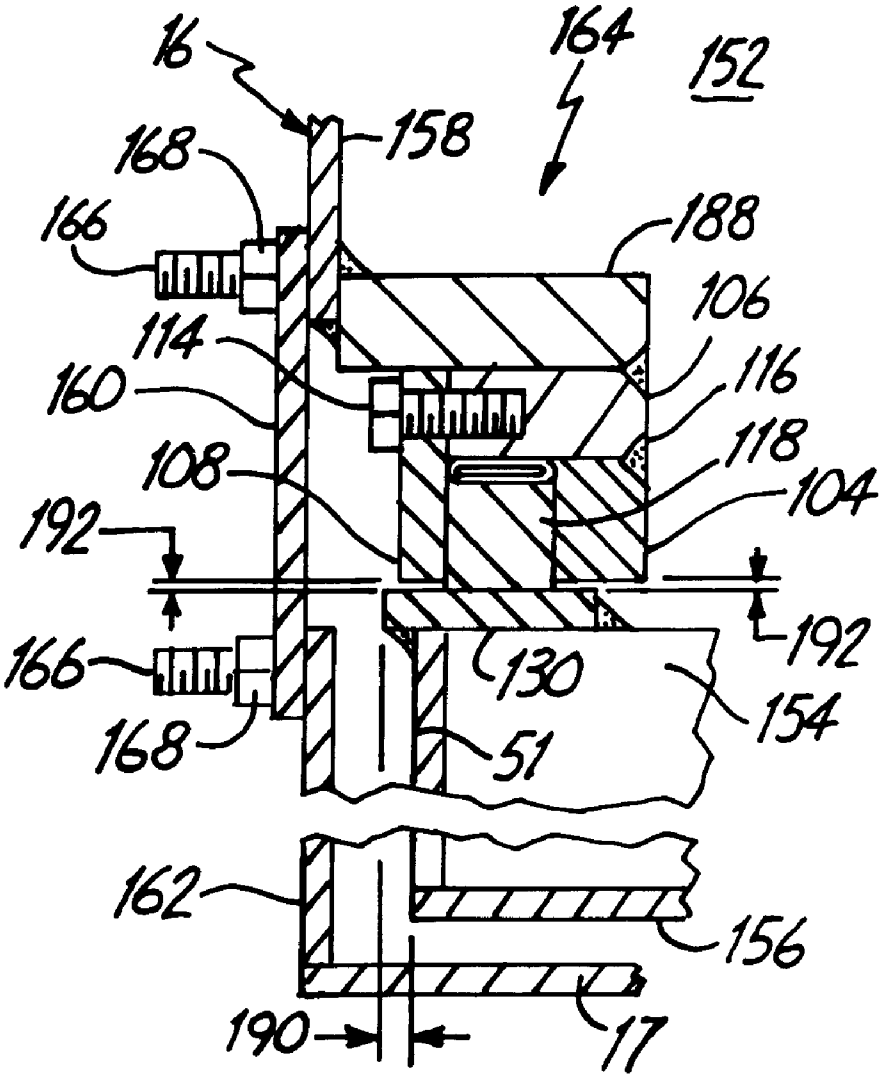
FIG. 13 is an enlarged sectional view of the seal portion of the second rotary drum mixer, enlarged from portion 13 of FIG. 12.

The seal cover ring 160 is located immediately in front of the seal assembly 164. The seal cover ring 160 is attached to the central portion 158 and the outer portion 162 by a number of circumferentially spaced bolts 166. As best seen in FIGS. 9 and 13, the seal cover plate 160 is readily removable by loosening of nuts 168 on bolts 166, thereby allowing access to the seal assembly 164.

In contrast to the prior art mixer 10, the outer portion 162 of the hood end wall 17 no longer contacts the material being mixed. Similarly, the circumferential wall 16 of the hood 15 does not contact the material being mixed. As best shown in FIG. 13, the outer portion 162 of hood face 16 is preferably spaced ⅝ of an inch to 1 inch from the second annular mounting flange 51. The circumferential wall 16 of the hood 15 is preferably spaced ⅝ of an inch to 1 inch from the circumferential wall 156 of the scoop chamber 152. Workers skilled in the art will appreciate that the seal cover ring 160, the outer portion 162 of the hood face 17 and the circumferential wall 16 of the hood 15 could all be removed without affecting the sealing of the drum mixer 150. However, these three members provide structural rigidity to the central portion 158 of the hood face 17. These three members also provide for stationary surfaces on the front and circumference of the hood 15 which are preferred when people may be close to the these surfaces such during input and discharge of material to or from the drum mixer 150. The seal cover ring 160, the outer hood face 162 and the outer hood circumferential wall 164 thus provide significant safety advantages.

The loading or inlet chute 38 of the drum mixer 150 is moved to a location in the central portion 158 of the hood end wall 17, and thus central to the scoop blades 154. The inlet 38 is preferably located on the downward side of the drum 11, as shown in FIG. 9 with reference to the direction of rotation 56. The central portion 158 of the hood end wall 17 also supports a discharge chute 170 and a covered vent 172. The discharge chute 170 is significantly wider than the discharge chute 81 of the prior art mixer 10. Cylinders 174 are used to power opening and closing of the discharge chute 170.

The design of the drum mixer 150 provides several important advantages. First, by enclosing the scoop blades 154 with the peripheral wall 156, there is no clearance tolerance which must be maintained between the scoop blades 154 and the peripheral wall 16 of the stationary hood 15. In the design of the prior art mixer 10, the rotating scoop blades 54 essentially "scraped" particulate material off the stationary circumferential wall 16. The clearance between the scoop blades 54 and the peripheral wall 16 had to be tightly maintained for effective scraping and to prevent the buildup of particulate material on the circumferential wall. The absence of any critical clearance tolerance between the scoop blades 154 and the stationary peripheral wall 16 of the hood 15 simplifies manufacture of the drum mixer 150. The present design prevents any buildup of material between the scoop blades 154 and the stationary hood wall 16, which both improves mixing and makes the mixer 150 easier to clean.

Additionally, there is no possibility for grinding of the particulate material between the scoop blades 154 and the tubular outer wall 16 of the hood 15. Because the blades 154 of the present design are circumferentially enclosed at their outer radius, there is no longer two surfaces immediately adjacent each other which move relative to one another and are flooded with particulate material. There is no possibility of grinding of particulate material between the blades 154 and the stationary hood 15.

Relocating the loading chute 38 to the central portion 158 of the end wall 17 allows the circumferential wall 156 and the second annular mounting flange 51 to avoid any cutouts 52 which were required in the prior art design. Circumferential wall 156 and the annular mounting flange 51 accordingly can be continuous sheet structures which do not permit any passage of material therethrough.

During rotation of the drum 11, the particulate material tends to gather on the side rotating upward, (i.e., the left side in FIG. 9 and 11, with rotation 56 of the drum in a clockwise direction). Placing the inlet chute 38 on the right or downward side allows additional material to be input in the drum mixer 150 than would be possible if it were mounted on the left or upward side of the drum 11. Workers skilled in the art will appreciate that if the direction of rotation of the drum 11 is reversed, then the location of the inlet chute 38 should similarly be reversed. That is, if the drum 11 from the front view is rotated in a counter-clockwise direction, then the downward side of the drum 11 will be on the left hand side, and the inlet chute 38 should be placed on the left side of the central portion 158 of the hood face 17.

Because the scoop blades 154 of the present design are circumferentially enclosed at their outer radius, the blade design itself can be significantly altered to better perform the dropping function within the scoop chamber 152. Thus another improvement over the prior art mixer 10 involves the shape of the blades 154, best shown in FIG. 11. Each of the blades 154 is angled inward toward the direction of rotation. In the preferred embodiment, each of the blades 154 has a relatively flat inner portion 176 angled inward at an angle of about 30° to a radial line. The movement of material into and out of the blades 154 occurs along the inside diameter or drop radius 178. This 30° angle of entrance into the material provides for a scoop 154 which obtains better and more complete fill of particulate material.

The configuration of the blades 154 also provides for a correct angle of material dropping to create a relatively continuous curtain 180 of material falling off of the drop radius 178 of each blade 154. The drop curtain 180 is also fairly consistent with little regard for the amount of material being mixed by the drum mixer 150. For instance, blade **154*a* is at about a 10 o'clock position. The pouring surface of blade 154*a* is nearly horizontal, and particulate material begins to flow off the edge of the blade 154*a* even if the scoop 154*a* is not completely full. If the scoop 154*a* was completely filled, a substantial amount of material will already have been poured from the scoop 154*a* prior to reaching the 10 o'clock position. Regardless of the amount of material that was initially in the scoop 154*a***, a fairly continuous flow of material will be achieved from the 10 o'clock position onward. For most particulate materials, a 45° angle of orientation of the blade surface, achieved by blade 154*b* at about a 12 o'clock position, is sufficient for all the material contained in the scoop 154*b* to be poured within the scoop chamber 152. The material poured off the blade 154*b* at the 12 o-clock position will have a significant horizontal velocity, and thus the drop curtain 180 will extend over to about a 1 o-clock position. Thus, with the blade configuration shown, the drop curtain 180 for most particulate materials will be fairly consistent and uniform during a range of travel from the 10 o'clock position to a 1 o-clock position. This drop curtain 180 remains fairly consistent and uniform over the 10 o-clock position to the 1 o-clock position regardless of whether the mixer 150 is ⅛ full of particulate material or filled to capacity. The range of travel of the drop curtain 180 is important for correct positioning of spray devices (not shown) and correct positioning of the discharge chute 170. The blade surface pouring particulate material becomes vertical by about the 2 o'clock location of blade 154*c*, assuring complete emptying of the scoop 154*c*. Workers skilled in the art will appreciate that the angle of the blades 154 can be modified as desired for the desired path of flow curtain 180.

It should be noted that the total range of travel of a drop curtain 180 depends upon the amount of material picked up in each scoop 154. As the mixer 150 becomes emptied, the scoop 154 will start emptying at the 10 o'clock position and have enough time to be completely empty before it reaches a 12 o'clock position. However, when the scoops are substantially full during a full mixing, the drop curtain 180 extends further. Accordingly, the discharge chute 170 is wide enough to receive a substantial flow of material for the maximum rate of discharge of the mixer 150, and is also positioned to completely remove all material from the mixer 150 at the lowest rate of discharge during emptying of the mixer 150.

A second change with regard to the blade configuration involves the use of blade back section 182. The blade back section 182 is preferably formed of a sheet of metal attached between the peripheral wall 156 and the backside of each of the scoop blades 154. The back blade section 182 creates a dead spot 184 in each of the scoops 154 which is not open to the particulate material. The back section 182 prevents any buildup of material between the outer section 186 of blade 154 and the peripheral wall 156 where the two are joined. The back section 182 also encourages a faster discharge or drop of material out of each of the scoop blades 154.

The drum mixer 150 of the present invention also utilizes a different seal configuration 164, best shown in FIG. 13. The seal configuration 164 differs not only in location on the drum mixer 150 as described above, but also in orientation of the bladder 116 and seal member 118 relative to the interface being sealed. In the seal assembly 164 shown in FIG. 13, the bladder 116 is located radially inward from the seal member 118. The seal hoop 130 is welded to the second annular mounting flange 51 and to the front edge or drop radius 178 of each of the scoop blades 154. In this configuration, the bladder 116 biases the seal member 118 radially outward toward the seal hoop 130. A stationary seal mounting ring 188 is welded or otherwise attached to the hood face. The spacer ring 104, the compression ring 106 and the seal mounting ring 108 can be structured similarly to the spacer ring 104, the compression ring 106 and the seal mounting ring 108 of the seal assembly 100 shown in FIG. 6. Each of the spacer ring 104, the compression ring 106 and the seal mounting ring 108 are preferably formed from a 36 mild or a 304 stainless steel. Workers skilled in the art will appreciate that the spacer ring 104, the compression ring 106 and the seal mounting ring 108 could be provided as a single piece rather than three pieces welded together. The preferred seal member 118 is formed of a ½ inch to ⅞ inch square braided GORETEX flexible fabric. The seal hoop 130 is preferably about 5/16 of an inch thick and machined from 304 stainless steel. An overlap 190 of the seal hoop 130 over the second annular mounting flange 51 is preferred so that the seal hoop 130 and the seal member 118 will be close to the edge of the rotating scoops 154 while still providing a full length for the gaps 192, 194. Preferably, the attachment bolts 114 are spaced at about a 9 inch distance around the circumference of the scoop section 152.

Figure 14:
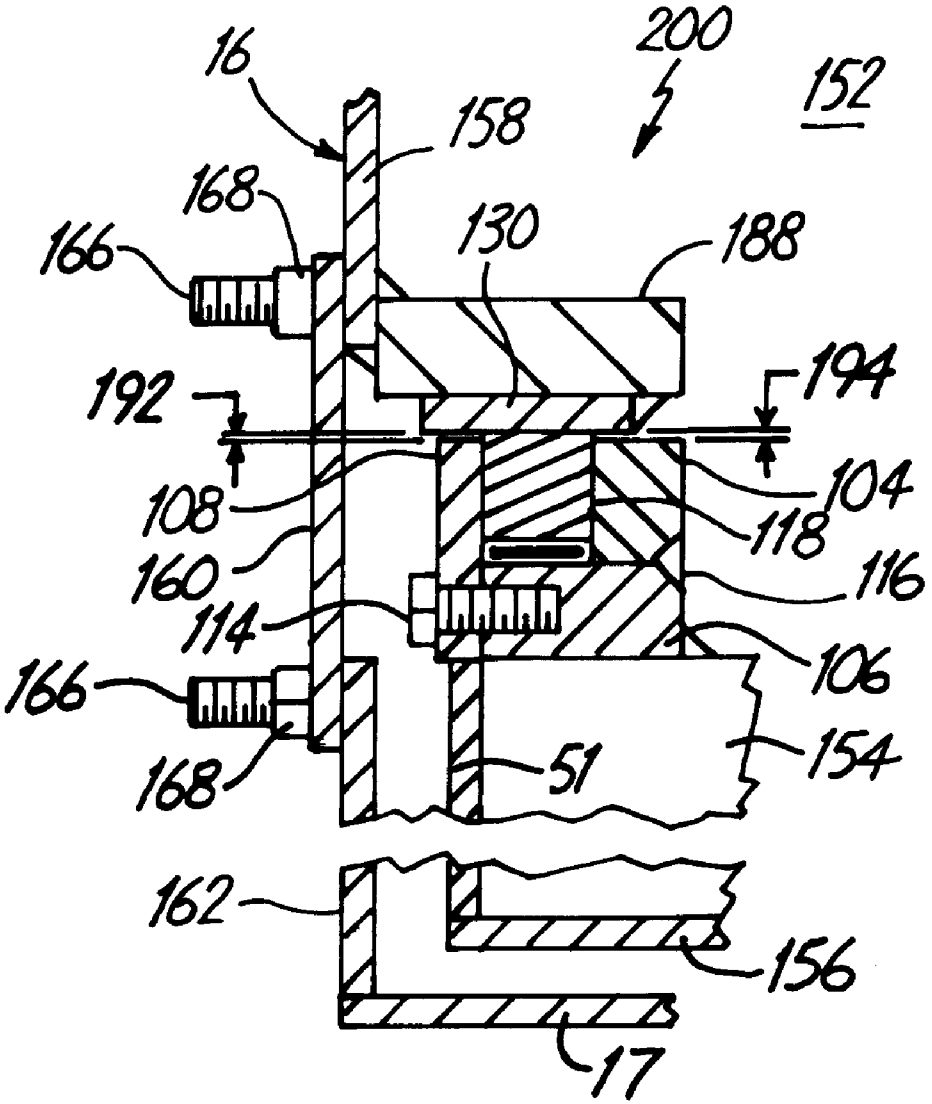
FIG. 14 is an enlarged sectional view of an alternative seal portion of the second rotary drum mixer.

FIG. 14 shows an alternative seal configuration 200 that may be used with the scoop chamber 152 of the present invention. The seal configuration 200 of FIG. 14 differs from the seal configuration 164 of FIG. 13 with respect to rotation and orientation of the seal member 118 and the bladder 116. In FIG. 14, the seal member 118 and the bladder 116 rotate with the scoop blades 154 and bias the seal member 118 radially inward against the seal hoop 130. The seal hoop 130 is stationary and attached to the stationary hood 15. While this design allows the seal member 118 to be bias radially inward similar to the seal assembly of FIGS. 6–8, it requires the seal member 118 and the bladder 116 to rotate with the scoop blades 154. This rotation of the bladder 116 provides difficulty if a continuous pressure source is desired to be applied to the bladder 116 to maintain continuous pressure during rotation of the drum 11 and mixing. In the configuration shown in FIG. 14, the bladder 116 should be inflated and then closed and the pressure source for the bladder 116 should be removed while the mixer 150 is off and not rotating. This is in contrast to the seal assemblies 164, 100 of FIG. 13 and FIGS. 6–8 which permit continual attachment of the pressure source 124 to the bladder 116 during use of the mixer 150 and rotation of the drum 11.

Figure 6:
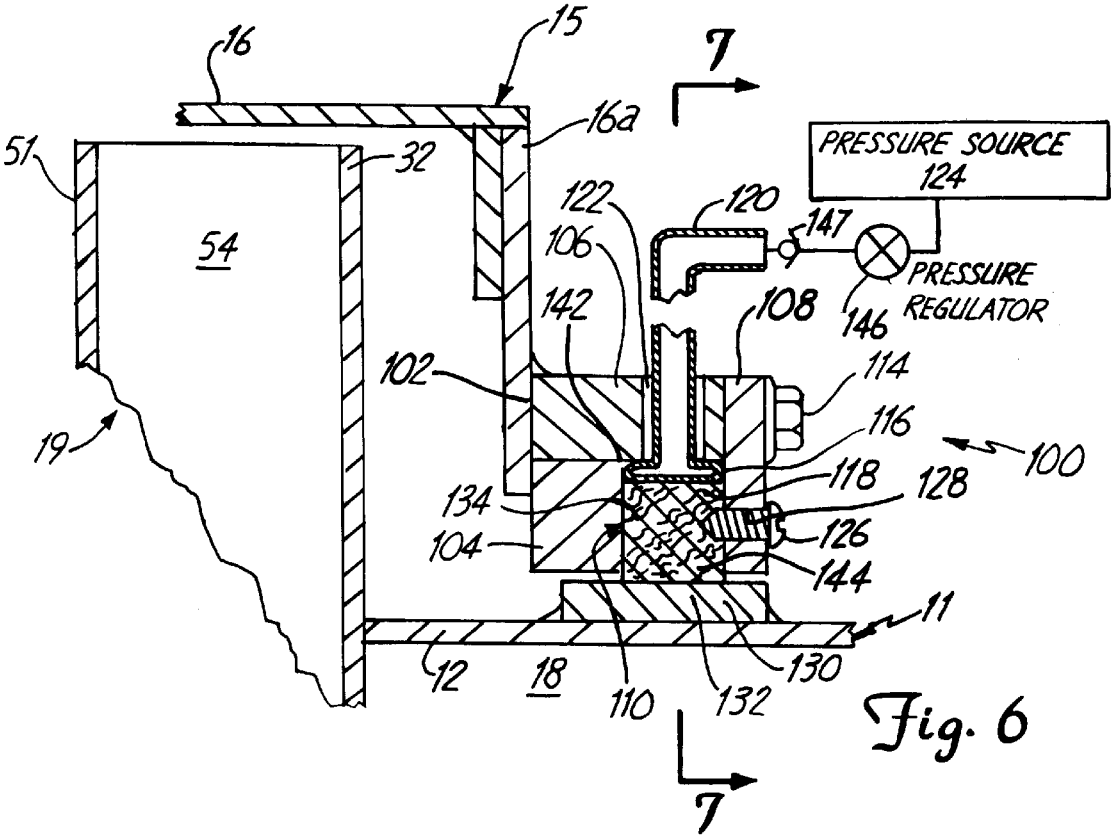
FIG. 6 is an enlarged sectional view of the first seal assembly, as taken from area 6 in FIG. 5.
Figure 8:
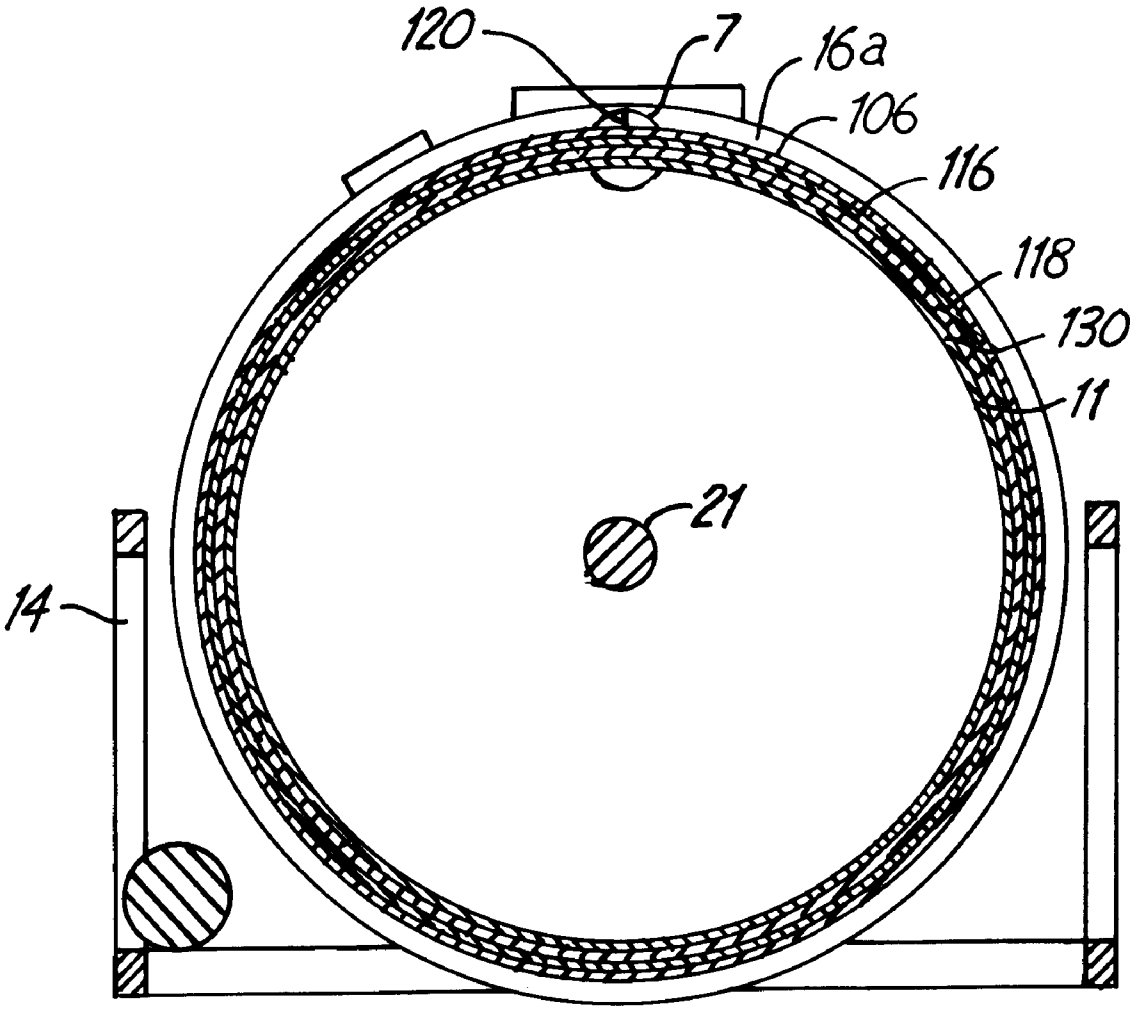
FIG. 8 is a sectional view of the first seal assembly as taken along line 8—8 of FIG. 5.
Figure 10:
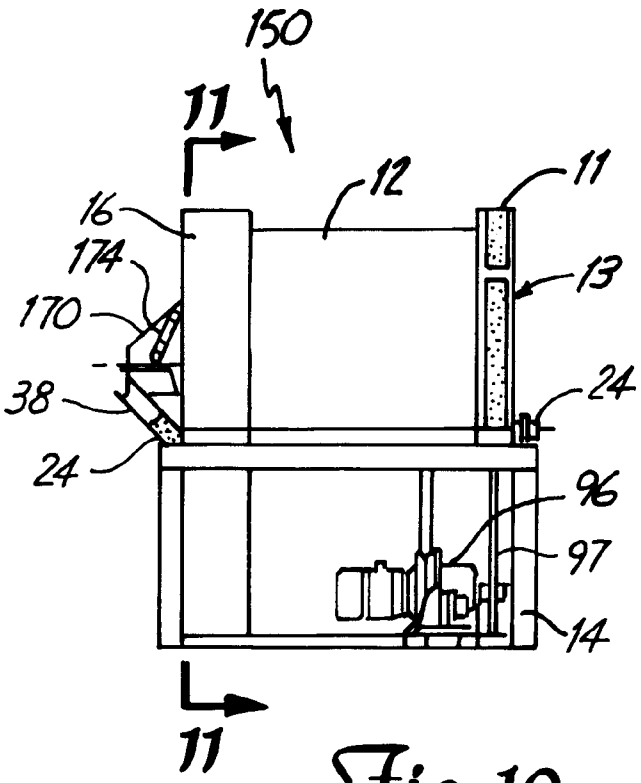
FIG. 10 is a side view of the second rotary drum mixer of FIG. 9.

Workers skilled in the art will appreciate that the seal configuration 100 of FIGS. 6–8 could also be used to seal with the scoop blade configuration 154 of the present invention. To use the seal assembly 100 of FIGS. 6–8, a flange (not shown) extending axially outward should be attached to the inside diameter of the second annular mounting flange 51 and the scoop blades 154. The seal hoop 130 may then be attached to the outside surface of the flange. Alternatively, the seal configuration 100 of FIGS. 6–8 could be attached directly on the exterior surface of circumferential wall 156.

Figure 15:
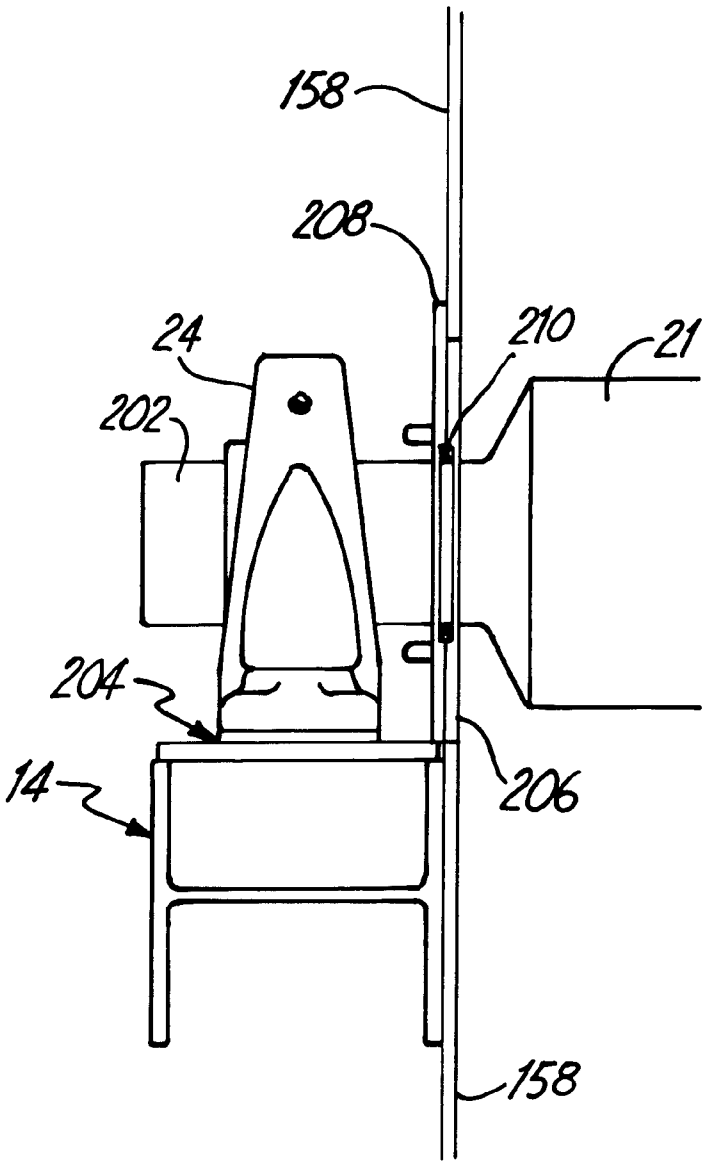
FIG. 15 is an enlarged view showing the front end of the shaft 21 from FIG. 12 in more detail.

FIG. 15 depicts the front end of the shaft 21 of the present invention in more detail. The shaft 21 has a shaft journal 202 which is mounted for sliding rotation on a front bearing 24. The front bearing 24 may be mounted on a shim 204 for correct positioning of the shaft 21 relative to the frame 14. An internal seal plate panel 206 and an external seal plate panel 208 are used to enclose a shaft seal member 210. The shaft seal member 210 may be made out of the same material as the seal member 118. It is noted however that the shaft 21 does not need to be sealed with an inflatable bladder 116. The shaft 21 is of a much smaller circumference and is not hollow, and accordingly has a much less chance of non-circularity or deformation during use as compared to the drum 11.

Although the present invention has been described with reference to preferred embodiments, workers skilled in the art will recognize that changes may be made in form and detail without departing from the spirit and scope of the invention.

What is claimed is:

1. A drum mixer for mixing particulate product, the drum mixer comprising:

a drum having a peripheral wall defining a main mixing chamber, the drum being rotatable about a generally horizontal rotation axis, the drum having an open end;

a scoop section comprising:

a peripheral wall defining a scoop chamber and fixed relative to the peripheral wall of the drum, the scoop chamber being open to the main mixing chamber on one side and providing a center opening on an opposite side;

plurality of scoop blades, each of the scoop blades attached to the peripheral wall of the scoop section and extending inward to a drop radius;

a hoop attached as part of the scoop section and fixed relative to the plurality of scoop blades, the hoop having an axially extending seal surface;

a stationary hood face covering the center opening of the scoop chamber, the stationary hood face having a discharge opening disposed within the drop radius to receive particulate product dropped from the plurality of scoop blades;

a seal member biased radially against the seal surface of the hoop for inhibiting fine particles of particulate product from passing between the rotatable drum and the stationary hood face, the seal member maintained stationary relative to the stationary hood face;

wherein the plurality of scoop blades are radially enclosed by the peripheral wall of the scoop section.

2. The drum mixer of claim 1, further comprising:

a seal enclosure fixed relative to the stationary hood faces the seal enclosure receiving the seal member within the seal enclosure, the seal enclosure preventing the seal member from axial movement; and an inflatable bladder positioned within the seal enclosure and against the seal member to bias the seal member radially against the hoop when the inflatable bladder is inflated.

3. The drum mixer of claim 2, further comprising:

an inflation line connecting the inflatable bladder with a pressure source;

a pressure regulator in the inflation line to regulate the pressure in the inflatable bladder during operation of the drum mixer.

4. The drum mixer of claim 2, wherein the seal member is a single member which maintains force continuity across an entire circumference of the hoop.

5. The drum mixer of claim 2, further comprising:

an inflation line connecting the inflatable bladder with a pressure source; and a check valve in the inflation line to prevent deflation of the inflatable bladder upon failure of the pressure source.

6. The drum mixer of claim 2, wherein the seal surface of the hoop faces radially inward, and wherein the inflatable bladder is positioned radially inward from the seal member for biasing the seal member radially outward against the hoop when the inflatable bladder is inflated.

7. The drum mixer of claim 2, wherein the seal surface of the hoop faces radially outward, and wherein the inflatable bladder is positioned radially outward from the seal member for biasing the seal member radially inward against the hoop when the inflatable bladder is inflated.

8. The drum mixer of claim 1 wherein the seal member is a flexible strip of fabric packing material.

9. The drum mixer of claim 1, wherein the hoop is attached at the drop radius of the scoop blades, and wherein the seal member is biased radially outward from the stationary hood face to the hoop.

10. The drum mixer of claim 1, further comprising:

a bladder positioned against the seal member to bias the seal member radially against the hoop;

a housing attached to the stationary hood face for retaining the seal member and the bladder in a cavity which is open to the hoop, the cavity being defined by:

a first axially facing side wall;

an annular outer wall spaced from the hoop and attached to the first axially facing side wall; and a second axially facing side wall spaced from the first side wall and attachable to the annular outer wall, wherein the second side wall is removable from the outer wall to allow access to the seal member and the bladder;

wherein the bladder is restricted within the cavity from expanding in all directions except radially outward toward the seal member.

11. The drum mixer of claim 1, further comprising a side wall attached to the scoop blades, the side wall extending from the center opening to the peripheral wall of the scoop section to axially enclose the scoop blades, and wherein the hoop is disposed radially inward from the side wall at the drop radius of the scoop blades.

12. The drum mixer of claim 11, further comprising:

a seal access ring removably attached to the stationary hood face and covering the seal member;

an outer hood face extending radially outward from the seal access ring, the outer hood face running parallel and immediately adjacent to the side wall of the scoop section; and a peripheral hood wall extending axially from the outer hood face, the peripheral hood wall running parallel and immediately adjacent to the peripheral wall of the scoop section.

13. The drum mixer of claim 1, further comprising:

a shaft upon which the rotatable drum is mounted, the shaft defining a shaft axis;

a motor for rotating the rotatable drum about the shaft axis; and a shaft seal biased against the shaft for inhibiting particulate product from leaving the mixing chamber and the scoop chamber along the shaft.

14. The drum mixer of claim 1, further comprising an inlet hopper opening in the stationary hood face within the drop radius.

15. The drum mixer of claim 1, wherein each of the scoop blades comprises:

an outer portion attached against the peripheral wall of the scoop section;

an inner portion extending at an angle into the direction of rotation; and a back curve attached from the peripheral wall of the scoop section to a back side of the inner portion, thereby preventing particulate product from being caught between the outer portion of the scoop blade and the peripheral wall of the scoop section.

16. The drum mixer of claim 15, wherein the scoop section further comprises:

a side wall attached to the scoop blades and to the peripheral wall of the scoop section to axially enclose the scoop blades.

17. The drum mixer of claim 1, wherein the hoop is attached to the plurality of scoop blades.

18. The drum mixer of claim 1, wherein the scoop section comprises an annular mounting flange attached to the plurality of scoop blades and the peripheral wall, and wherein the hoop is attached to the annular mounting flange.

19. The drum mixer of claim 1, wherein the hoop is attached to the peripheral wall.

20. A drum mixer for mixing particulate product, the drum mixer comprising:

rotatable drum having a peripheral wall defining a main mixing chamber, the rotatable drum being rotatable about a generally horizontal rotation axis, the rotatable drum having an open end;

a scoop section comprising:

a peripheral wall defining a scoop chamber and fixed relative to the peripheral wall of the rotatable drum, the scoop chamber being open to the main mixing chamber on one side and providing a center opening on an opposite side; and a plurality of scoop blades, each of the scoop blades attached to the peripheral wall of the scoop section and extending inward to a drop radius;

a stationary hood covering the center opening of the scoop chamber, the stationary hood having a discharge opening disposed within the drop radius to receive particulate product dropped from the plurality of scoop blades;

a hoop attached to one of the scoop section and the stationary hood, the hoop having an annular surface which extends axially;

a seal member biased radially against the annular surface of the hoop for inhibiting particles of product matter from passing between the rotatable drum and the stationary hood along the hoop;

wherein the plurality of scoop blades are radially enclosed by the peripheral wall of the scoop section.

21. The drum mixer of claim 20, further comprising:

a bladder for biasing the seal member radially against the hoop;

a housing attached to one of the stationary hood and the rotatable drum for retaining the seal member and the bladder in an annular cavity which is open to the hoop, the annular cavity being defined by:

a first axially facing side wall;

an annular outer wall spaced from the hoop and attached to the first axially facing side wall; and a second axially facing side wall spaced from the first side wall and attachable to the annular outer wall, wherein the second side wall is removable from the outer wall to allow access to the seal member and the bladder;

wherein the bladder is restricted within the annular cavity from expanding in all directions except radially toward the seal member.

22. The drum mixer of claim 21, wherein the hoop is attached to the rotatable drum such that the hoop rotates with rotation of the rotatable drum, and wherein the housing is attached to the stationary hood such that the housing, the bladder and the seal member remain stationary with the stationary hood.

23. The drum mixer of claim 21 wherein the hoop is attached to the stationary hood such that the hoop remains stationary with the stationary hood, and wherein the housing is attached to the rotatable drum such that the housing, the bladder and the seal member rotate with rotation of the rotatable drum.

24. The drum mixer of claim 21, wherein an aperture is defined in the housing, the seal assembly further comprising:

an inflation line extending through the aperture to connect the bladder with a pressure source;

a pressure regulator in the inflation line to regulate the pressure in the bladder.

25. The drum mixer of claim 21 wherein the bladder extends substantially along the entire length of the seal member.

26. The drum mixer of claim 20 wherein the seal member is a single member with a rectangular cross-sectional configuration and a cylindrical inside surface and contacts the hoop continuously along the cylindrical inside surface, thereby maintaining force continuity across an entire circumference of the hoop.

* * * * *

UNITED STATES PATENT AND TRADEMARK OFFICE

CERTIFICATE OF CORRECTION

PATENT NO. : 5,906,435

DATED : MAY 25, 1999

INVENTOR(S) : THOMAS A. CALLAGHAN ET AL.

It is certified that error appears in the above-identified patent and that said Letters Patent is hereby corrected as shown below:

Col. 17, line 13, before "plurality", insert --a--

Col. 17, line 32, delete "faces" and insert --face,--

Col. 19, line 11, before "rotatable" insert --a--

Signed and Sealed this

Twenty-first Day of December, 1999

*Attest:*

Q. TODD DICKINSON

*Attesting Officer*

*Acting Commissioner of Patents and Trademarks*